United States Patent [19]

Jordan

[11] 4,356,618

[45] Nov. 2, 1982

[54] PRODUCTION OF ROLLED PRODUCTS

[75] Inventor: Richard M. Jordan, Hook Norton, England

[73] Assignee: Alcan Research and Development Limited, Montreal, Canada

[21] Appl. No.: 89,396

[22] Filed: Oct. 30, 1979

[30] Foreign Application Priority Data

Nov. 3, 1978 [GB] United Kingdom ..... 43105/78

[51] Int. Cl.[3] ..... B22D 11/00; B22D 19/00; B22D 11/126

[52] U.S. Cl. ..... 29/527.6; 29/527.7; 164/108; 164/419; 164/476; 164/487; 164/461

[58] Field of Search ..... 113/118 D, 116 CC; 29/527.7, 527.6; 164/108 (U.S. only), 109, 112 (U.S. only), 86, , 417, 76, 80, 86, 419, 473, 476, 59.1, 487

[56] References Cited

U.S. PATENT DOCUMENTS

| | | | |
|---|---|---|---|
| 586,319 | 7/1897 | Pedder | 164/108 |
| 642,158 | 1/1900 | Russell | 164/109 |
| 1,826,860 | 10/1931 | Armstrong | 29/157.7 X |
| 2,102,394 | 12/1937 | Trembour | 164/109 |
| 2,543,936 | 3/1951 | Reynolds | 164/419 |
| 3,020,222 | 2/1962 | Zambrow et al. | 164/109 |
| 3,055,067 | 9/1962 | Roth | 164/419 |
| 3,079,654 | 3/1963 | Brenner | 164/86 |
| 3,136,008 | 6/1964 | Maier et al. | 164/86 |
| 3,367,397 | 2/1968 | Hansson | 164/86 |
| 3,406,737 | 10/1968 | Duflot et al. | 164/419 |

FOREIGN PATENT DOCUMENTS

| | | | |
|---|---|---|---|
| 521436 | 2/1956 | Canada | 164/419 |
| 731126 | 2/1943 | Fed. Rep. of Germany | 164/109 |
| 46-21829 | 6/1971 | Japan | 164/86 |

*Primary Examiner*—Fancis S. Husar
*Assistant Examiner*—V. K. Rising
*Attorney, Agent, or Firm*—Cooper, Dunham, Clark, Griffin & Moran

[57] ABSTRACT

A composite metal sheet or plate is manufactured by completely immersing an assembly of parallel or substantially parallel metal core sheets in molten metal at a lower melting point than the metal of the core sheets, and after the molten metal has solidified reducing the thickness of the ingot by hot rolling in a direction generally normal to the planes of the core sheets. The method has a particularly useful but by no means exclusive application in the production of reinforced aluminium alloy sheets and plates.

6 Claims, 5 Drawing Figures

LAMINATES
MONOLITHIC
FRACTURE TOUGHNESS K (MNm$^{-3/2}$)
CRACK LENGTH A -mm
0
10
20
30
40
50
60
70
30
35
40

PRODUCTION OF ROLLED PRODUCTS

This invention relates to the production of composite metal sheet or plate in which layers or plies of metal are bonded to each other and is more particularly but not exclusively concerned with such sheet or plate in which there are multiple layers or plies.

It is envisaged for example that considerable improvements in the fracture toughness of sheets or plates of strong, but somewhat brittle aluminium alloys can be achieved by laminating relatively thick layers or plies of the strong alloy with intermediate thin layers of a more ductile aluminium alloy, but no economic way has hitherto been found of making a satisfactory plate product with a multiplicity of layers. This is however only one application of the present invention. In other applications the composite sheets or plates may be made from layers or plies of other metals or metal alloys.

It is well known to produce composite aluminium alloy sheet or plate, in which a core alloy is clad with a relatively thin surface layer of a different alloy on one or both faces. This has been achieved by bonding a plate of the surface alloy to each side of an ingot of the core alloy by hot rolling. Whilst this technique has been found entirely satisfactory for cladding purposes and has been employed for many years it has not been found possible to build up a composite ingot comprising a multiplicity of plies of plates or sheets by rolling them together in a single operation. If this is attempted it is found that there is a considerable tendency for de-lamination to occur at the interface of the inner plies.

To produce a composite aluminium/aluminium alloy sheet having many plies it has been necessary to use multiple rolling stages in each of which two clad sheets are joined to each other by rolling. Alternatively complicated techniques such as diffusion bonding or explosive welding have been employed.

It was long ago proposed to produce composite ingots consisting of a core alloy, completely surrounded at its periphery by a surface alloy. This was achieved by arranging the casting mould of the core alloy concentric with and slightly higher than the mould for the surface alloy. As the core alloy passed downward from its mould it was enveloped by the surface alloy cast into the lower mould. Since the outer surface of the core alloy is still very hot at that stage, it undergoes surface melting by contact with the molten surface alloy and consequently the two become firmly bonded together. However such a procedure is clearly impracticable for casting composite aluminium alloy ingots at the casting rates employed today, because present-day techniques rely upon the direct application of coolant water to the surface of the ingot as it emerges from the casting mould. It would be unacceptably hazardous to apply coolant water to the surface of the emerging core alloy ingot immediately above the entry of the molten surface alloy to the lower concentric mould. In any event a procedure of that nature would be impracticable for producing an ingot comprising parallel plate-like layers of core alloy, particularly where such layers are thin.

It will readily be understood that when casting a molten aluminium alloy between two already-formed parallel, plate-like aluminium alloy layers it is necessary to introduce the molten aluminium alloy into the direct chill casting mould in such a way that the molten alloy flows inwardly from one or both side edges towards the centre and in so doing becomes somewhat chilled by contact with the already solidified plate-like layers. Thus where it is necessary to raise the surface temperature of the plate-like layers at their mid-points sufficiently to cause surface melting to bond to the molten metal there is a risk of substantial melting of the plate-like layers at their side edges.

In an experiment carried out by the present applicants with the object of producing an ingot which could be rolled down into a multi-ply sheet an assemblage of spaced aluminium plates was lowered into the sump of an aluminium ingot being cast in a direct chill casting mould, equipped with a "hot top", using a level pour technique. Because of the good thermal conductivity of aluminium it could safely be assumed that the temperature of the plates and the molten metal would very rapidly become equalised in the "hot top". The temperature of the molten metal at entry into the "hot top" was therefore chosen so as to raise the temperature of the assembly of plates to the solidus temperature of the alloy from which they were formed. Although the composite ingot formed in that way could be rolled very satisfactorily to produce a multi-ply composite sheet or plate it was found that excessive and somewhat uncontrolled melting of the edges of the plates took place as a result of the inward flow of molten metal between the edges. In consequence excessive edge trimming of the hot rolled slab was required. In an effort to overcome this defect the temperature of the molten metal was reduced with the intention of achieving bonding between the plates of core alloy and the intermediate layers of cast alloy in a subsequent hot rolling operation. First attempts to proceed in that way proved unsuccessful and the bonding between the various layers proved unsatisfactory, just as when attempts were made to laminate a stack of plates by hot rolling. In these attempts to produce a multi-ply composite sheet or plate the composite ingot was cast in such a way that the tail end of the assembly of plates of core alloy remained projecting from the top end of the cast ingot. In rolling down an ingot of this type it was found that progressive delamination occurred during each rolling pass.

According to this invention there is provided a method of making a composite metal sheet or plate comprising completely submerging an assembly of spaced substantially parallel metal core sheets in metal of lower melting point than the metal of the core sheets so that the metal of lower melting point fills the spaces between the core sheets, and after said metal of lower melting point has solidified to form a composite ingot, reducing the thickness of the composite ingot in a direction normal to the general planes of the core sheets by hot rolling the ingot.

Thus in carrying out the method according to the present invention, the assembly of plates of core alloy is completely enveloped in the cast metal. In one embodiment, using direct chill casting techniques, when an overhead support for the assembly of plates was released and the casting of molten metal continued until the assembly was submerged and a substantial tail of metal (for example 5 cm. for an ingot of 12.7 cm thickness) formed above it, it was found that the composite ingot could be rolled down to a hot slab, in which the layers were firmly bonded to one another. The hot slab thus produced could be reduced to any desired thickness in perfectly conventional manner. In carrying out the bonding operation the rolling conditions may vary to some extent in dependence upon ingot thickness and the composition of the cast alloy. Experience shows that there is a somewhat critical minimum percentage reduction required to obtain adequate bonding between the cast metal and the core plates. This varies not only with the composition of the cast metal and the core plates but also with the percentage reduction in each pass of the hot rolling operation employed to achieve bonding. In general the larger is the percentage reduction obtainable in a single pass of the hot rolling mill the smaller is the number of passes and the total percentage reduction required to achieve bonding of the core plates to the cast metal. The maximum reduction obtainable in a given situation is governed by the capacity of the rolling mill. For that reduction the maximum temperature permissible must be determined by experience (having regard to the metal compositions and other factors); too high a temperature will be indicated by the onset of centre cracking in the composite ingot whilst too low a temperature will give rise to edge cracking. In general the temperature employed for hot rolling the composite ingot should be in the temperature range normally employed for hot rolling an ingot of the alloy used as the cast alloy.

In one example where the cast alloy was an Al-Zn-Mg strong alloy (AA 7010) and the cast-in plates were Al (AA 1100), a 12.7 cm. thick ingot was heated to a temperature in the range of 410°-440° C. and subjected to 80% reduction by successive reductions of 20 to 25%. The total percentage reduction employed in this example was more than sufficient to bond the cast alloy to the core plates.

It is believed that the effectiveness of the operation is dependent upon the outer envelope of cast alloy to maintain a close contact between the plates of core alloy and the cast metal and more particularly to exclude oxygen from the metal interfaces during the heating of the composite ingot to the rolling temperature and most especially in excluding access of oxygen to the interface during the rolling operation. The outer envelope of cast metal serves both as a clamp to prevent separation of the layers of metal brought into intimate contact during the course of the casting operation and as a hermetic seal to prevent any internal oxide formation during the roll bonding step. After completion of the roll bonding step the slab is trimmed so as to remove the ends and side edges, from which the intermediate layers of core alloy are absent.

In putting the invention into effect the plates of core alloy preferably occupy 2-40% of the thickness of the ingot after making due allowance for material to be scalped from the faces of the ingot before rolling. Where the core plates are steel it is preferred for the plates to occupy 3-10% of the thickness of the ingot. The practical lower limit of percentage thickness is set by the extent to which the steel core plates undergo thermal buckling in the casting operation.

Where the core plates are aluminium the practical lower limit of thickness occupied by them is around 5-10% because of difficulties experienced with edge melting and thermal buckling. Here it will be realised that increased thickness of the individual core plates reduces edge melting and buckling difficulties.

The upper limit of thickness occupied by core plates is dependent primarily on the ability to achieve flow of cast metal into the spaces between the core plates so as completely to fill such spaces. This again is dependent upon the spacing between the core plates and their width. Ingots of 20 cm. width have been cast successfully with a space of 6 to 12 mm. between adjacent plates. With wider ingots it is preferred that the interval between the plates should be somewhat greater, for example 19 to 25 mm.

In one example of carrying the invention into effect a rectangular mould 20.3 cm. by 7.6 cm. was employed. This was equipped with a "hot top" having an overhang of 13 mm. so that the aperture in the hot top was 17.8 cm×5 cm. The "hot top" was provided with a feeding groove extending across the full width of the two ends, so that on pouring, a stream of metal enters both ends of the "hot top" and flows towards the middle. The plates for forming the intermediate layers or plies in the eventual product are made up into an assembly at the correct spacing between them in a jig and are then held in this position by welding narrow straps across the two ends, the straps being preferably formed of the same metal as the plates. A simple guide is preferably provided above the casting mould and the plate assembly is fed down through the guide into the bottom of the metal sump after the first few cms. of the ingot has been cast. The solidifying metal securely grips the lower end of the assembly, which is laterally located at its upper ends by the guide, through which it is drawn downwardly as the ingot descends. The casting of the ingot is continued to produce a tail of say 5 cm. after the upper end of the plate assembly has been submerged in the metal in the "hot top".

It is not necessary to have a conventional "hot top" arrangement, but merely a level pour system of casting, so that the top of the mould is left clear for the insertion of the solid plates.

In one example where (AA 1100) plates were intended to occupy 10% by volume of the relevant portion of the AA 7010 ingot, the liquid 7010 was introduced at a temperature of 690° (approximately 50° C. in excess of its liquidus temperature). This was found satisfactory to ensure a full flow of metal to the middle of the space between adjacent plates without premature solidification, but did not raise the temperature of the plates to their solidus temperature (645° C.) in the central region. In this case the plates exhibited very limited melting at their side edges and it was only necessary to remove a very narrow strip at the edges of the zone initially occupied by the plate assembly.

In a typical operation for effecting improvement in fracture toughness the plate assembly is composed of 6 plates of (AA 1100) aluminium having a thickness of 2 mm. and a spacing of 15 mm. between adjacent plates. This assembly is cast into an ingot of a thickness of 12.7 cm. The casting alloy is a strong alloy having the following compositions: Zn 6%, Mg 2.4%, Cu 1.75%, Zr 0.13%, Fe 0.1%, Si 0.1%, Ti 0.05%, Al balance, and is supplied to the mould at a temperature of 690° C.

The cast ingot was scalped to remove 2.5 mm. of the outer skin from each of the center faces of strong alloy.

After hot rolling to 2.5 cm. thick slab under the above-described conditions to effect secure roll bonding between the layers or plies of metal in the cast ingot, the slab was trimmed at butt and tail ends and at the side edges to remove the unlaminated portions of the slab, which was then further reduced to various thicknesses by hot and cold rolling. In this way it has been found possible to produce rolled sheet and plate in the range 2.5 cm. down to 2.5 mm. thick, and having 13 plies.

Whilst the procedure of the present invention is very effective for producing aluminium alloy composites having cast-in layers of relatively ductile and relatively high melting point aluminium or aluminium alloys in a matrix of a relatively strong, but relatively low melting point alloy, it may also be employed to produce composites in which the plate-like elements are formed of a stronger metal, such as sheet steel, which are cast into a matrix of relatively ductile aluminium, or of weaker material of lower melting point, such as lead.

Two examples of the manufacture of rolled products in accordance with the present invention will now be described. The description makes reference to the accompanying diagrammatic drawings in which.

EXAMPLE 1

Figure 1:
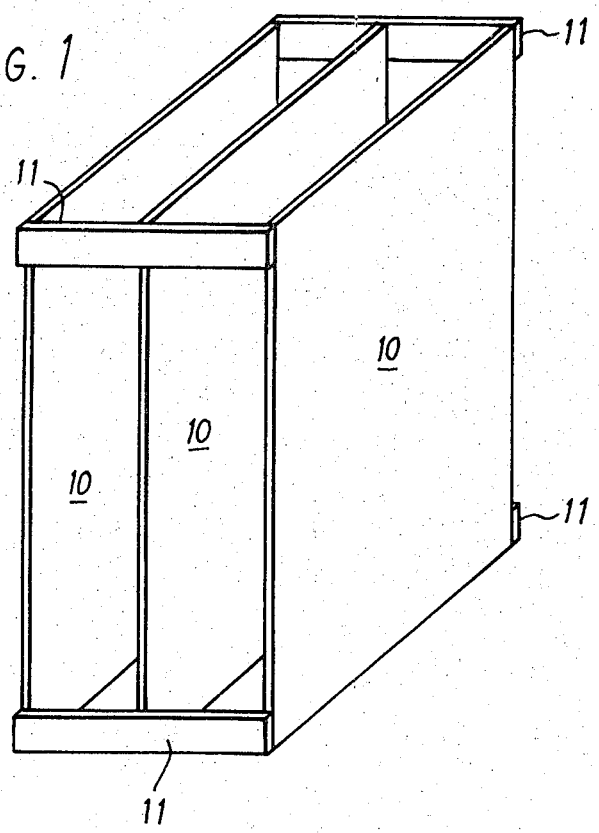
FIG. 1 shows an assembly of mild steel plates as used in Example 1.
Figure 4:
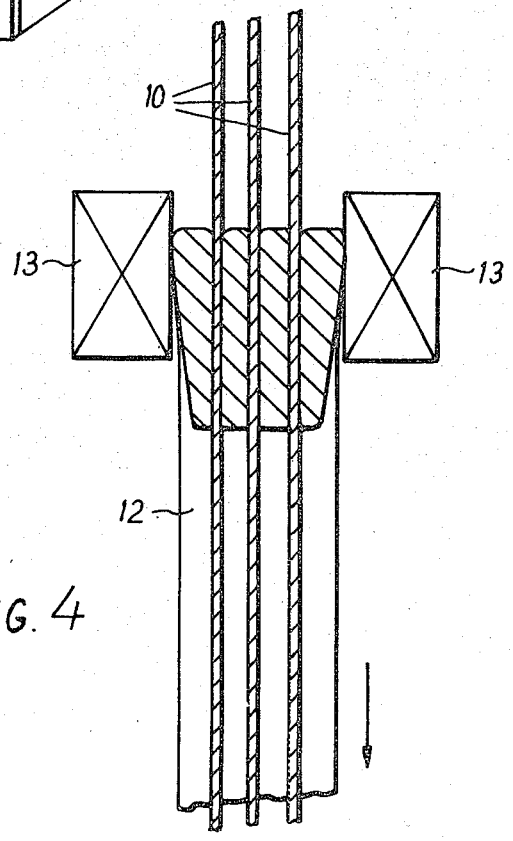
FIG. 4 illustrates the method of feeding the solid metal plates into the ingot during pouring.

Referring to FIG. 1, an assembly of three mild steel plates 10, each 25.4 cm. wide, 30.5 cm. long and 3 mm. thick and held in parallel spaced relationship to each other by straps 11 welded to the corners of the plates was fed, in the manner illustrated in section in FIG. 4, into an ingot 12 of AA 7010 aluminium during casting of the ingot in a direct chill mould 13 which effectively forms a downwardly directed nozzle. A level pour technique is used in the casting process. The cross-section of the ingot was 30.5 cm×12.7 cm. The casting temperature was maintained in the range 690° C. to 700° C. In the drawing, the hatched area of the ingot denotes the liquid metal, the unhatched area denotes the solidified metal.

Figure 2:
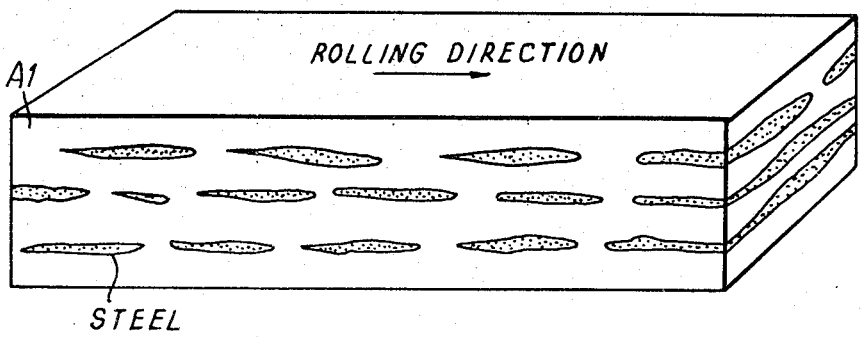
FIG. 2 shows the rolled product produced in Example 1.

After casting, the ingot was stress relieved for 8 hours at 430° C. On cooling, a block 30.5 cm.×12.7 cm.×45 cm. long and incorporating the three mild steel plates was cut from the ingot, the steel plates being completely enclosed in the AA 7010 alloy. A 2.5 mm. thick layer was removed from each rolling face of the resulting 7-ply block, after which the block was re-heated to 430° then hot rolled to 19 mm. thickness using 25 to 30% reduction in each pass. No annealing was carried out between passes, and the layers of steel were found to "neck" down and to fracture. The layers of AA 7010 alloy became welded together where the steel fractured, leaving a composite material having a section of the kind shown in FIG. 2, in which the darker areas represent steel.

EXAMPLE 2

Figure 3:
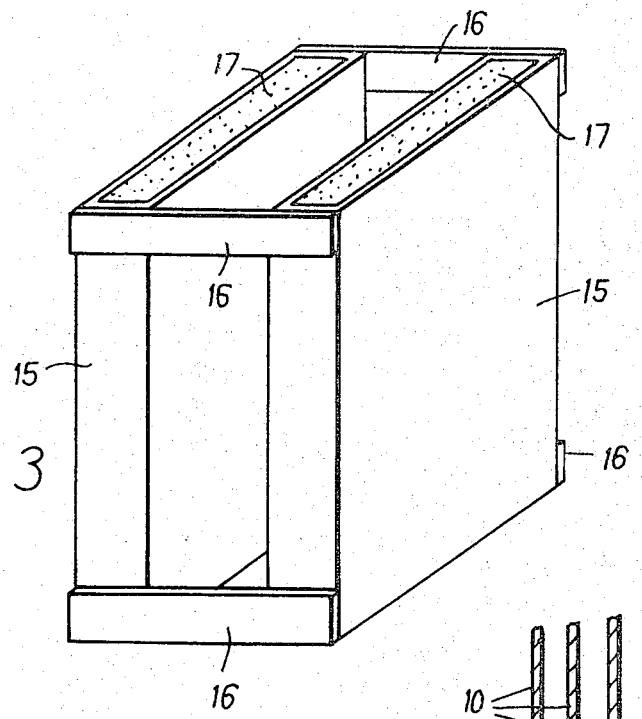
FIG. 3 shows an assembly of metal boxes or containers as used in Example 2.

Referring to FIG. 3 of the drawings, two boxes 15 measuring 15.2 cm.×15.2 cm.×13 mm. and open at the top were made from AA 1100 alloy and were secured together by aluminium alloy straps 16 welded to the boxes. The boxes were then filled with molten lead 17. On cooling to room temperature, the resulting assembly was then fed into a 20.3 cm.×7.6 cm. DC ingot using the same procedure as described in Example 1 except that the metal of the ingot was AA 1100 alloy and cast at a temperature in the range 720° to 730° C. The lead melted during casting, but remained in position in the boxes. On cooling, a block 20.3 cm.×7.6 cm. a 25.4 cm. was cut from the ingot so as to include both of the boxes but leaving the whole of the box assembly enclosed by the AA 1100 alloy. A 2.5 mm. thick layer was then cut from each rolling face of the block, after which the block was re-heated to 250° C. and was rolled down to a thickness of 9.5 mm. All of the internal interfaces of the resulting laminate were found to be securely bonded together.

The following table shows a comparison of the tensile properties of a 2.5 cm. thick 13 ply laminate made from a 30.5 cm×12.7 cm. direct-chill ingot of AA 7010 alloy with cast-in plates of AA 1100 alloy made in the manner previously described, with monolithic AA 7010 alloy processed in the same way.

| | 0.2% Proof Stress (N/mm²) | U.T.S. (N/mm²) | % Elong. 5 cm. gauge length |
|---|---|---|---|
| 13 ply laminates | 440 | 480 | 7 |
| Monolithic 7010 | 472 | 533 | 14 |

The 1" thick test pieces were in the L-T orientation and were all in T6 condition.

The table shows that the laminates have inferior tensile properties, as might be expected, because they contain 10% of the weak AA 1100 alloy.

Figure 5:
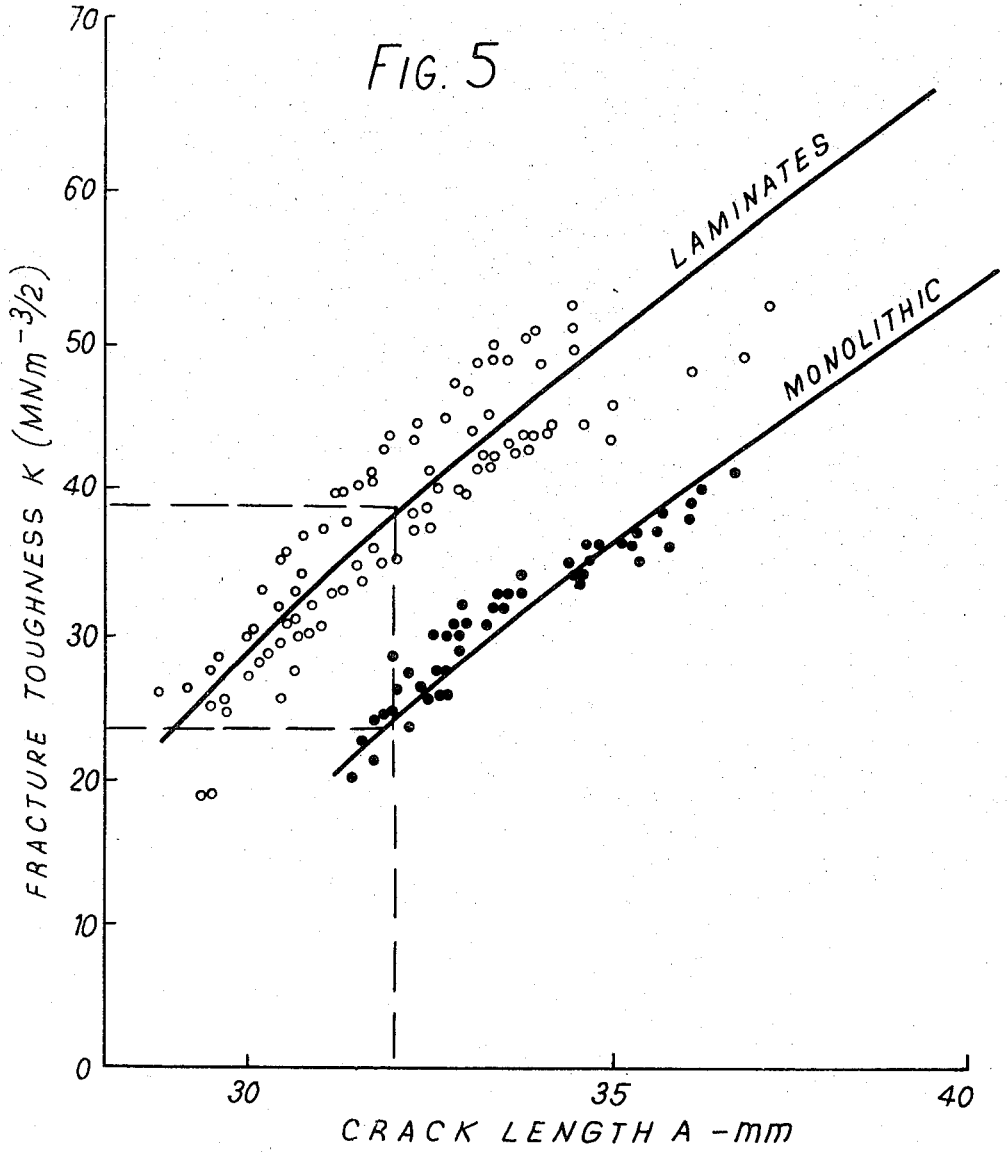
FIG. 5 is a graph showing a comparison of crack resistance curves of laminated materials made by methods according to the present invention and monolithic materials.

The laminated materials are however designed to provide a higher resistance to crack propagation than the ingot material, allied to comparable tensile properties. When crack resistance curves of laminated and monolithic materials are compared as shown in FIG. 5, in which K represents the resistance to crack growth as a function of crack length A, it will be seen that the laminates have a considerably better fracture toughness than the monolithic material. For example, for a crack length of 32 mm:

$$K_{monolithic} = 22\ \mathrm{MN}\cdot\mathrm{m}^{\frac{-3}{2}}$$

$$K_{laminate} = 39\ \mathrm{MN}\cdot\mathrm{m}^{\frac{-3}{2}}$$

I claim:

1. A method of making a composite metal sheet or plate comprising producing an ingot in a direct chill casting mould by a direct chill casting technique and simultaneously lowering into the mould a plurality of spaced parallel plates made from a metal having a higher melting point than the continuously cast metal, the side edges of said plates being covered by the cast metal, and terminating the flow of cast metal into the mould only after the top edges of the plates have become submerged in the cast metal in the mould, whereby the plates are completely submerged in the cast metal and, after the cast metal has solidified to form a composite ingot, reducing the thickness of the composite ingot in a direction normal to the general plane of the core sheets by hot rolling the ingot thereby to complete the bonding of the metal of the plates to the cast metal and to form the sheet or plate.

2. A method as claimed in claim 1 comprising the further step of trimming from the rolled composite plate the edge portions thereof into which the core sheets do not extend.

3. A method as claimed in claim 1 wherein the plates and cast metals are both aluminium alloys.

4. A method as claimed in claim 1 wherein the core sheets are made from steel.

5. A method as claimed in claim 1, wherein the hot rolling is continued until the metal core sheets fracture and the metal of lower melting point welds to itself through the fractures.

6. A method as claimed in claim 1, wherein in said hot rolling, the ingot is subjected to a plurality of passes through a rolling mill, the thickness of the ingot being reduced by 20% to 25% of its original thickness at each pass.

* * * * *